US008079876B2

(12) United States Patent
Wang et al.

(10) Patent No.: US 8,079,876 B2
(45) Date of Patent: Dec. 20, 2011

(54) ELECTRICAL CARD CONNECTOR

(75) Inventors: Leland Wang, Shenzhen (CN); Yun-Jen Lee, Tu-Cheng (TW); Jing-Jie Guo, Shenzhen (CN); Wei-Ping Liu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 158 days.

(21) Appl. No.: 12/507,030

(22) Filed: Jul. 21, 2009

(65) Prior Publication Data

US 2010/0015824 A1 Jan. 21, 2010

(51) Int. Cl.
*H01R 24/00* (2011.01)

(52) U.S. Cl. ..... 439/630; 439/862

(58) Field of Classification Search ..... 439/862, 439/630, 660

See application file for complete search history.

(56) References Cited

U.S. PATENT DOCUMENTS

| | | | | |
|---|---|---|---|---|
| 6,217,396 | B1 * | 4/2001 | Hwang et al. | 439/862 |
| 7,131,875 | B2 * | 11/2006 | Kodaira et al. | 439/862 |
| 7,329,146 | B2 * | 2/2008 | Yang et al. | 439/570 |
| 7,442,087 | B2 * | 10/2008 | Long et al. | 439/630 |
| 2002/0048999 | A1 * | 4/2002 | Ming-Hui | 439/660 |
| 2008/0012497 | A1 | 5/2008 | Chang | |
| 2009/0137136 | A1 * | 5/2009 | Shen | 439/83 |

FOREIGN PATENT DOCUMENTS

| | | |
|---|---|---|
| CN | 2587078 | 11/2003 |

* cited by examiner

*Primary Examiner* — Xuong Chung Trans

(74) *Attorney, Agent, or Firm* — Wei Te Chung; Andrew C. Cheng; Ming Chieh Chang

(57) ABSTRACT

An electrical card connector includes an insulating housing (1) with a number of passageways (115), a number of conductive contacts (3) retained in the passageways. Each contact includes a planar retaining portion (31), a solder portion (35) and a resilient arm (37). The solder portion extends from one end of the retaining portion and the resilient arm bends inversely from the opposite end of the retaining portion. The contact further includes a pair of tabs (39) bent inversely from two side ends of the resilient arm and extends between the retaining portion and the resilient arm. The pair of tabs define therebetween a slot space (391) correspondingly to receive the solder portion.

18 Claims, 5 Drawing Sheets

ELECTRICAL CARD CONNECTOR

BACKGROUND OF THE INVENTION

1. Field of the Invention

The present invention relates to an electrical connector, especially to a card connector with a conductive contact having preload function.

2. Description of Related Art

Electronic appliances, such as portable telephones, PDA, digital cameras and the like, are more and more popular. An IC card, such as a SIM card etc, is used in such electronic appliance for carrying information and identifying for a user. The IC card is usually connected to a printed circuit board (PCB) via a card connector.

Commonly, an electrical connector used for electrically connecting a SIM card to a printed circuit board mainly comprises an insulating housing and a plurality of contact contacts retained in the insulating housing. US. Pat. No. 2008/0124979 published to Wang on May 29, 2008 discloses a contact comprising a base portion retained in the insulating housing, a solder portion extending slantwise slightly from the base portion for soldering with a PCB and an elastic arm extending from the base portion and above the solder portion for electrically connecting with a SIM card. However, when the SIM card is inserted and pressed against the elastic arm of the contact, the elastic arm moves downwardly and touches with the solder portion and accordingly causes damage to the contact.

CN. Pat. No. 2587078 issued to Gao on Nov. 19, 2003 discloses another contact similar to the aforementioned contact, but different in that the solder portion extending downwardly a larger distance from the base portion. This larger distance between the solder portion and the elastic arm provides an enough deformation space for moving the elastic arm to avoid damage caused by interference occurred between the solder portion and the elastic arm of the contact.

Therefore, an improved card connector is desired to overcome the disadvantages of the prior arts.

SUMMARY OF THE INVENTION

An object of the present invention is to provide a card connector with an enough elastic deformation space for protecting the conductive contact.

In order to achieve above-mentioned object, an electrical card connector includes an insulating housing with a plurality of passageways, a plurality of conductive contacts retained in the passageways. Each contact includes a planar retaining portion, a solder portion and a resilient arm. The solder portion extends from one end of the retaining portion and the resilient arm bent inversely from the opposite end of the retaining portion. The contact further comprises a pair of tabs bent inversely from two side ends of the resilient arm and extends between the retaining portion and the resilient arm. A space is defined between the pair of tabs for avoiding interference with the solder portion.

Other objects, advantages and novel features of the present invention will become more apparent from the following detailed description of the present embodiment when taken in conjunction with the accompanying drawings.

DETAILED DESCRIPTION OF THE INVENTION

Figure 1:
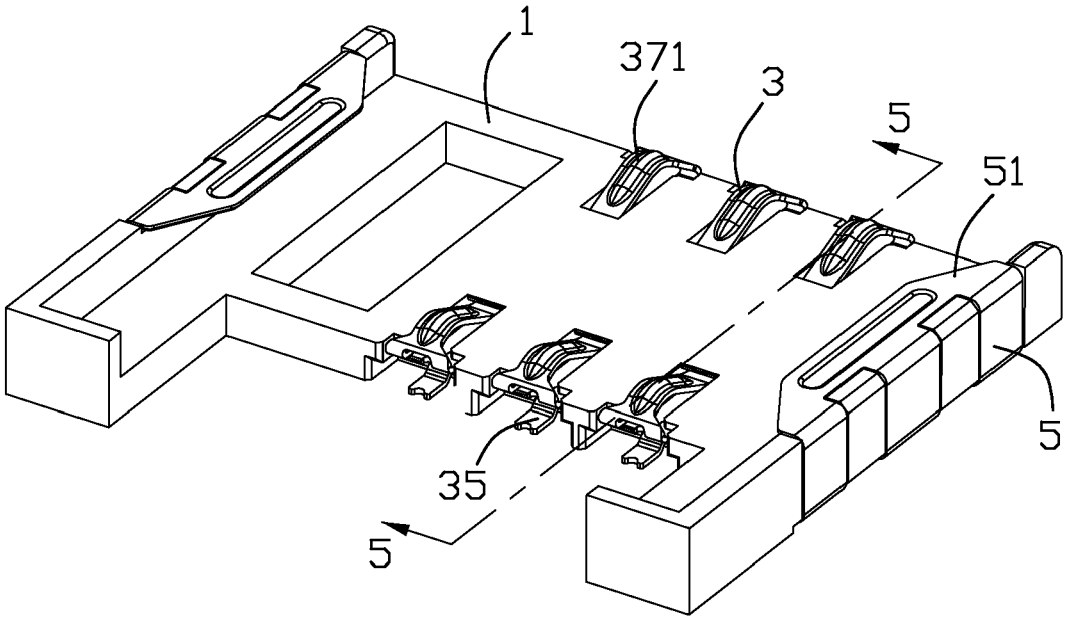
FIG. 1 is an assembled, perspective view of an electrical card connector in accordance of the present invention.

Reference will now be made to the drawing figures to describe the preferred embodiment of the present invention in detail.

Referring to FIG. 1, an electrical card connector used for connecting a IC card (not shown) to a printed circuit board (PCB, not shown) in accordance with the preferred embodiment of the present invention comprises an insulating housing 1, a plurality of conductive contacts 3 received in the insulating housing 1 and a pair of grounding members 5 assembled on two sides of the insulating housing 1.

Figure 2:
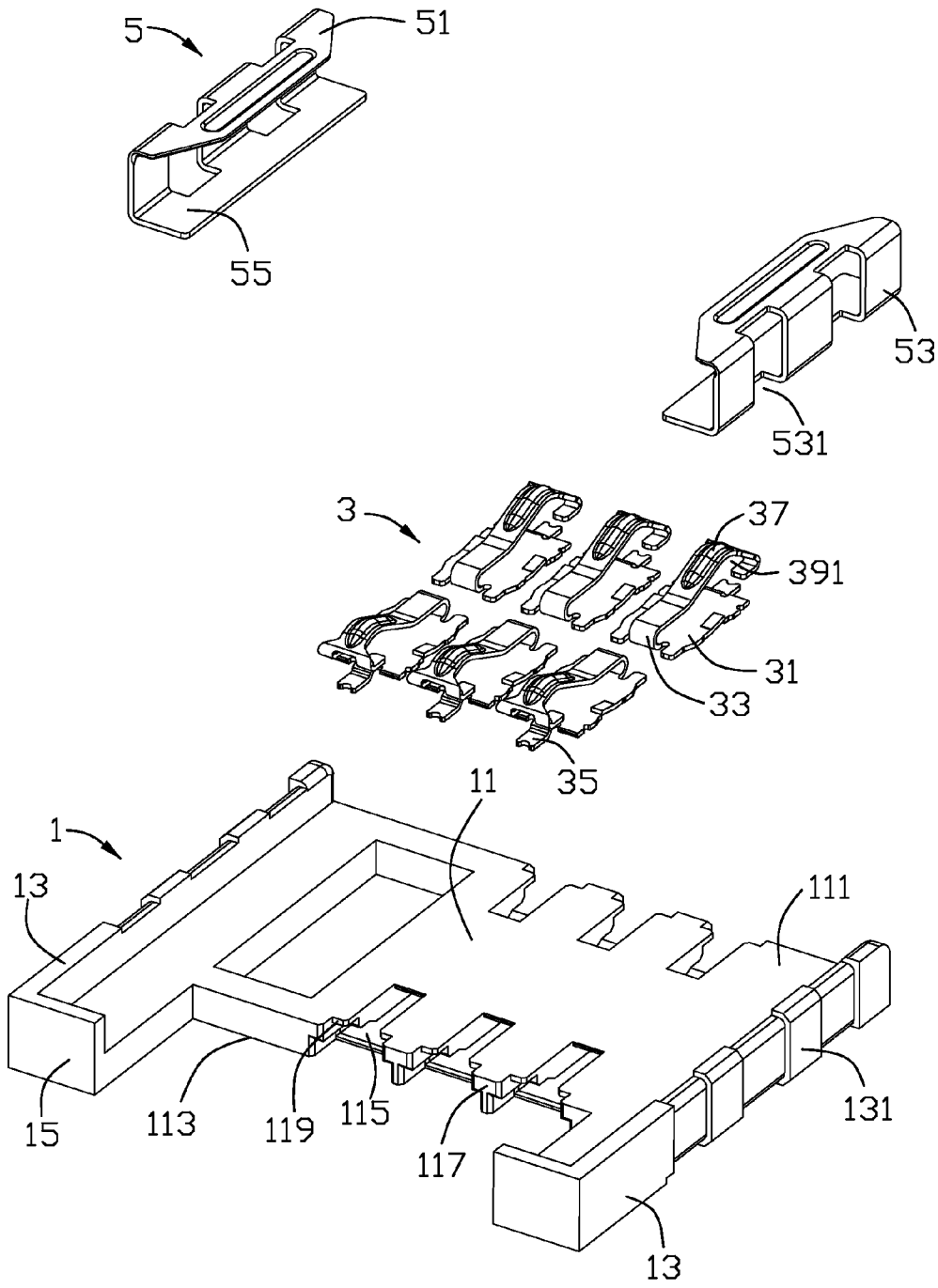
FIG. 2 is an exploded, perspective view of the electrical card connector shown in FIG. 1.

Referring to FIGS. 1 and 2, the insulating housing 1 comprises a base portion 11, a pair of side walls 13 formed on two opposite edges of the base portion 11 and a pair of back walls 15 extending vertically from rear edges of the side walls 13. The side walls 13 forms a plurality of protrusions 131. The base portion 11 defines an upper face 111 for supporting an inserting IC card and a lower face 113 opposite to the upper face 111 for engaging with a PCB. The base portion 11 defines a plurality of contact passageways 115 extending between the upper face 111 and the lower face 113 and exposed from the upper face 111. The passageways 117 are arranged into two symmetrical rows. The adjacent passageways 115 are detached from each other by several partition walls 117. Each passageway 115 has a pair of resisting portions 119 which are defined on the partition wall 117 between the passageway 115 and upper face 111.

Figure 3:
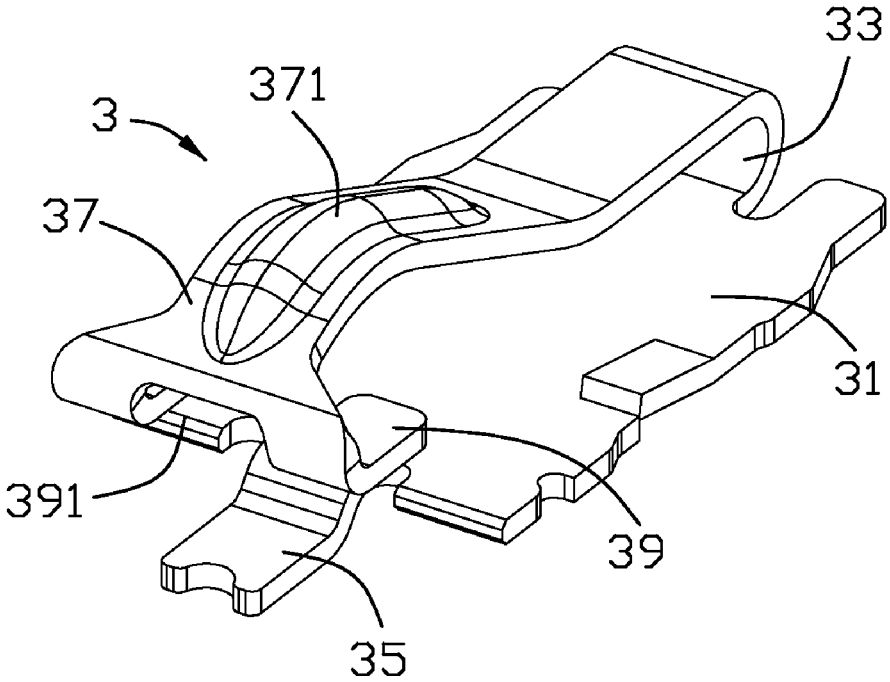
FIG. 3 is a perspective view of a conductive contact of the electrical card connector.

Referring to FIG. 3, the conductive contact 3 comprises a planar retaining portion 31 retained in the passageway 115, a solder portion 35 extending slantly and downwardly from one end of the retaining portion 31, a connecting portion 33 bending upwardly from the opposite end of the retaining portion 31, a resilient arm 37 extending from the connecting portion 33 to disposed above the retaining portion 31 and a pair of tabs 39 extending inversely from two front ends of the resilient arm 37 respectively to be disposed between the resilient arm 37 and the retaining portion 31. The resilient arm 37 has a curved contact portion 371 for electrically connecting with the IC card. The pair of tabs 39 engage with the pair of resisting portions 119 to ensure all the resilient arms 37 in a same horizontal plane and define a slot space 391 therebetween for receiving the solder portion 35.

Figure 4:
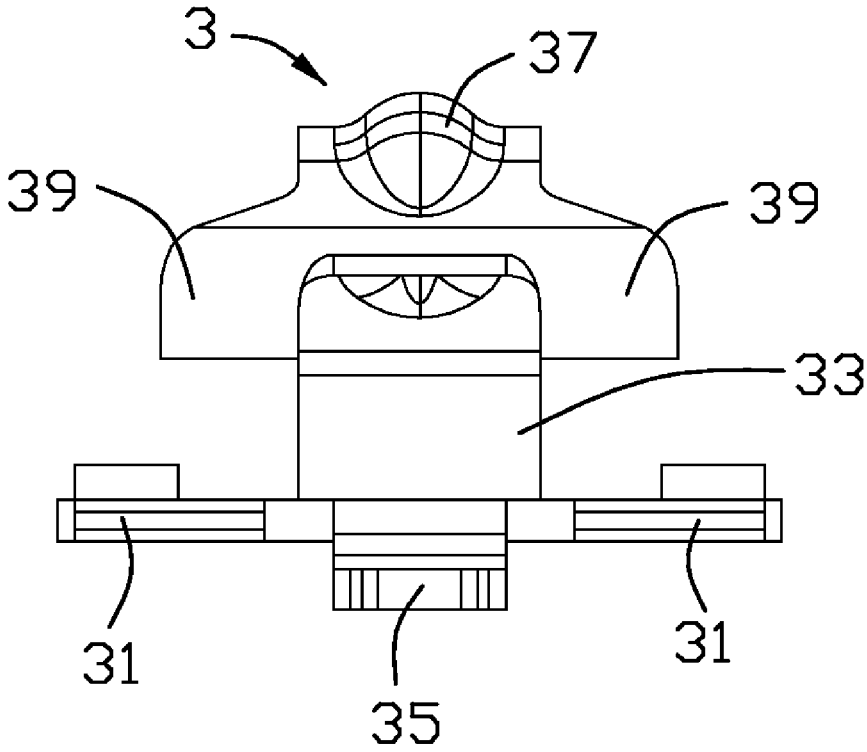
FIG. 4 is a front, elevation view of the conductive contact shown in FIG. 3.
Figure 5:
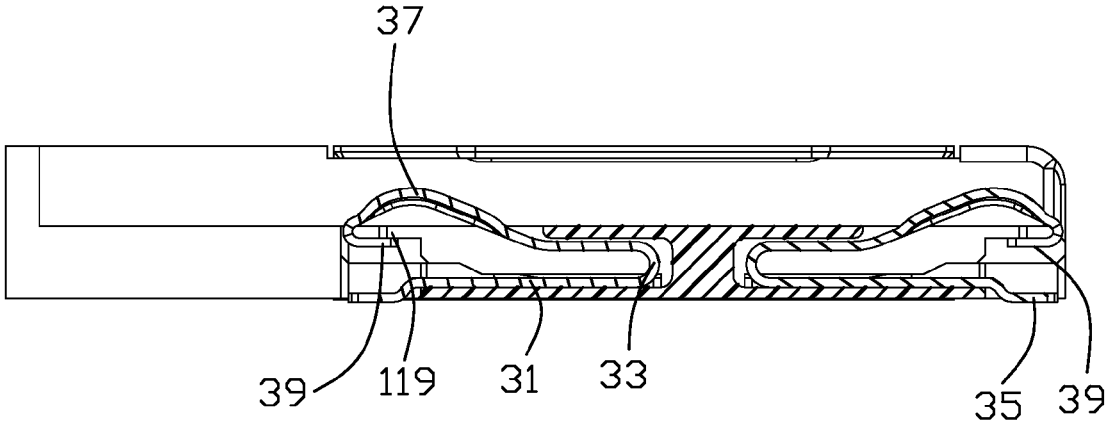
FIG. 5 is a cross-section view taken along line 5-5 of FIG. 1.

Referring to FIGS. 3-4, the distance between the pair of tabs 39 is larger than the width of the resilient arm 37. The width of the slot space 391 is larger than the width of the solder portion 35. When the resilient arms 37 of the conductive contacts 3 received in the passageways 115 are pressed by the IC card and move downwardly, the solder portion 35 is received in the slot space 391 to provide an enough deformation space such that the pair of tabs 39 won't touch with the solder portion 35. It reduces the size of the contacts 3 and also prevents damage to the conductive contacts 3.

Referring to FIGS. 1-2, the limiting member 5 comprises a side portion 53 and a pair of coat portions 51,55 bending vertically from two ends of the side portion 53 respectively. The side portion 53 defines several slots 531 for cooperating with protrusions 131 of the insulating housing 1. The upper coat portion 51 with the side walls 13 and the upper face 111 define a receiving room to receive the IC card.

However, the disclosure is illustrative only, changes may be made in detail, especially in matter of shape, size, and arrangement of parts within the principles of the invention.

What is claimed is:

1. An electrical card connector comprising:

an insulating housing having a plurality of passageways;

a grounding device attached to the insulating housing;

a plurality of conductive contacts retained in corresponding passageways, each contact comprising a planar retaining portion, a solder portion slantwise extending from one end of the planar retaining portion, and a resilient arm extending from the other end of the planar retaining portion, the resilient arm extending across the planar retaining portion and having an enlarged head portion oppositing to the solder portion, a pair of tabs formed at a free end of the head portion and upwardly abutting against a resisting portion of the housing for preloading said contact with respect to the housing, a space being defined by the pair of tabs and located between the tabs above the solder portion; and wherein a width of the space is greater than that of the solder portion so that the solder portion is capable of being accommodated in the space to prevent the tabs from contacting with the solder portion when the head portion is excessively downwardly pressed.

2. The electrical card connector as described in claim 1, wherein the space is defined between the two tabs of the contact.

3. The electrical card connector as described in claim 1, wherein the resilient arm of the contact has a protuberant contact portion adjacent to the enlarged head portion.

4. The electrical card connector as described in claim 3, wherein each contact forms a plurality of barbs along opposite side edges of the retaining portion.

5. The electrical card connector as described in claim 4, wherein the pair of tabs extending along a direction away from the solder portion and inserted into the passageways.

6. The electrical card connector as described in claim 1, wherein the insulating housing has a rectangular base portion and the passageways are arranged in opposite edges thereof and opened to the outside.

7. The electrical card connector as described in claim 6, wherein the insulating housing comprises two side walls with a plurality of protrusions formed on outer surfaces thereof.

8. The electrical card connector as described in claim 7, wherein the grounding device includes two U-shaped grounding members assembled to the side walls of the housing.

9. The electrical card connector as described in claim 8, wherein the U-shaped grounding member defines therethrough a plurality of holes engaging to the protrusions of the housing.

10. An electrical connector comprising:

an insulative housing defining a plurality of passageways each upwardly and outwardly laterally communicating with an exterior via an upper opening along an upward direction and a lateral opening thereof along a lateral direction in corresponding upper face and lateral side face of the housing; and a plurality of contacts disposed in the corresponding passageways, respectively, each of said contacts including a lower retention plate with a lower solder tail extending therefrom and an upper contacting section above said retention plate with a U-shaped linking portion connected between the upper contact section and the lower retention plate, at least one horizontal tab formed at a free end of the contacting section and upwardly abutting against a resisting portion of the housing for preloading said contact with regard to the housing; wherein both the tab and the solder tail are located adjacent to said lateral opening of the corresponding passageway while being offset from each other in a transversal horizontal direction perpendicular to an upward direction and the lateral direction so as to avoid contact with each other when the contacting section is excessively downwardly pressed; wherein the solder tail is essentially located at a center line of the contact along the lateral direction.

11. The electrical card connector as described in claim 10, wherein the upper contacting portion comprises an enlarged head portion on free end thereof and two tabs on two sides of the enlarged head portion.

12. The electrical card connector as described in claim 11, wherein a space is defined by the two tabs of the contact to accommodate the solder tail when the contacting section is excessively downwardly pressed.

13. The electrical card connector as described in claim 12, wherein the contacting section of the contact comprises a protuberant contact portion adjacent to the enlarged head portion.

14. The electrical card connector as described in claim 13, wherein each contact comprises a plurality of barbs along opposite side edges of the lower retention plate.

15. The electrical card connector as described in claim 10, wherein the insulative housing comprises two side walls with a plurality of protrusions formed on outer surfaces thereof.

16. The electrical card connector as described in claim 15, wherein the grounding device comprises two U-shaped grounding members assembled to the side walls of the housing.

17. The electrical card connector as described in claim 16, wherein each U-shaped grounding member defines therethrough a plurality of holes engaging with the protrusions of the housing.

18. The electrical card connector as described in claim 10, wherein the contacting section and the tab commonly defines a Y-shaped configuration in an extended manner.

* * * * *